United States Patent [19]

Fishlove

[11] 3,994,397

[45] Nov. 30, 1976

[54] PACKAGE UNIT FOR RETAINING A PLURALITY OF TUMBLERS, DRINKING GLASSES AND THE LIKE IN A DISPLAYED POSITION

[76] Inventor: Howard I. Fishlove, 720 N. Franklin St., Chicago, Ill. 60610

[22] Filed: June 27, 1974

[21] Appl. No.: 483,683

[52] U.S. Cl. ..... 206/429; 206/434; 229/40

[51] Int. Cl.[2] ..... B65D 65/08

[58] Field of Search ..... 206/174, 175, 180, 182, 206/186, 194, 197, 199, 426, 427, 429, 434, 491, 493; 229/40

[56] References Cited

UNITED STATES PATENTS

| | | | |
|---|---|---|---|
| 2,593,430 | 4/1952 | Frankenstein | 206/493 X |
| 2,722,365 | 11/1955 | Phipps | 206/149 X |
| 3,283,990 | 11/1966 | Tolaas | 206/182 X |
| 3,478,951 | 11/1969 | Graser | 206/434 X |

FOREIGN PATENTS OR APPLICATIONS

| | | | |
|---|---|---|---|
| 225,236 | 10/1959 | Australia | 206/194 |
| 1,145,091 | 3/1963 | Germany | 206/194 |
| 895,072 | 5/1962 | United Kingdom | 206/194 |

*Primary Examiner*—Steven E. Lipman
*Attorney, Agent, or Firm*—Max R. Kraus

[57] ABSTRACT

A package unit for tumblers, drinking glasses and the like comprising a single blank of sheet material which is scored, cut, folded and shaped to form a holder for the tumblers in a display condition, with said blank sheet forming a top section, a pair of spaced side sections, and a pair of spaced bottom sections with said bottom sections having interlocking means for interlocking engagement, and a partition section extending outwardly of one of said bottom sections, said side sections each having an elongated cutout and a flap extending inwardly into the cutout from the top section, said blank adapted to be folded with the bottom sections adapted to be interlocked so that the partition section is positioned intermediate the side sections, with the tumblers positioned inside the elongated cutouts and the side sections to rest on the bottom sections, with the flaps extending into the partition and a portion of the tumbler extending outwardly and forwardly of the side section so that the front of the tumbler is visible.

1 Claim, 4 Drawing Figures

PACKAGE UNIT FOR RETAINING A PLURALITY OF TUMBLERS, DRINKING GLASSES AND THE LIKE IN A DISPLAYED POSITION

BRIEF SUMMARY OF THE INVENTION

One of the objects of this invention is to provide a package unit comprising a holder formed of cardboard or the like for holding and retaining a plurality of containers, tumblers, drinking glasses and the like in a packaged condition, with the front or face of the tumbler or drinking glass positioned to extend outwardly of the sides of the holder so that the picture or drawing on the face of the tumbler is visible and not hidden from view and providing a saleable and marketable prepackaged set of tumblers which is appealing to the consumer or purchaser.

Another object of this invention is to provide a package for articles of the foregoing character which may be inexpensively made from a single blank of cardboard or like material and may be readily folded and interlocked to form a compact, easily transportable and readily displayed package unit in which the tumblers are prevented from being dislodged while on display or when being transported.

Another object of this invention is to provide a single sheet of cardboard or the like which is so formed that it may be folded and interlocked to form a holder for a plurality of drinking glasses or tumblers and which does not require any gluing of parts or the use of extraneous fastening means.

This invention has particular application to packaging tumblers or drinking glasses in which the face of the tumbler has an attractive picture thereon, such as for example, that of a girl who is clothed but whose clothing disappears or appears to be shedding when the tumbler is filled with a liquid and when moisture condenses on the tumbler, and said clothing reappearing on the girl when the moisture dries. Such tumblers are usually used for drinks containing liquor and the like and are well-known and have widespread sale. An object of this invention is to provide a package unit of such tumblers in which the picture on each of the tumblers is displayed so that the front portion of the tumbler is in clear view of the purchaser and may be seen without any portion of the package covering the face of the tumblers.

Another object of this invention is to provide a very inexpensive structure which will serve to enhance the sale of prepackaged tumblers and the like.

Figure 3:
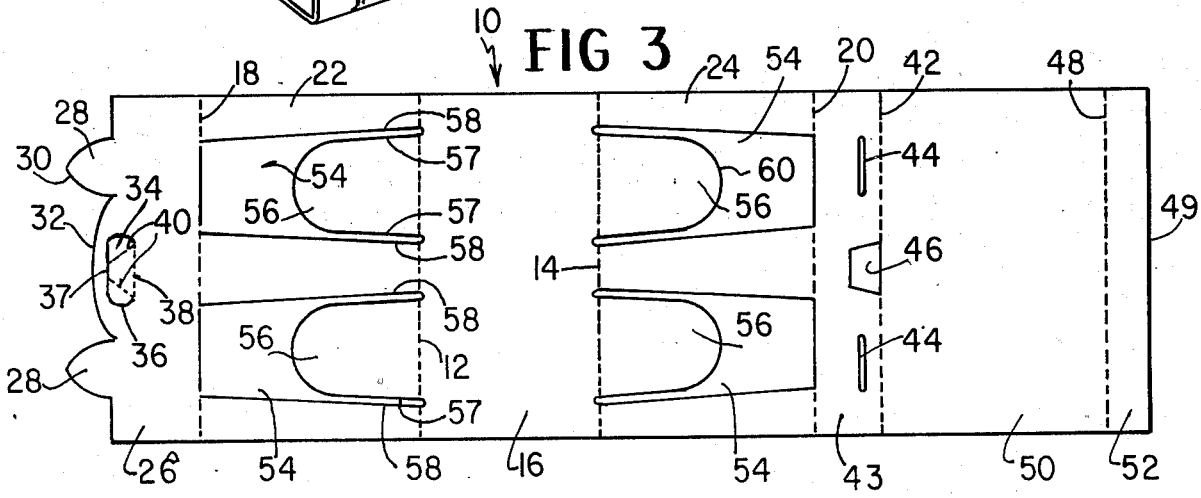
FIG. 3 is a top plan view of the blank forming the holder.

The blank or sheet from which the holder forming the package is made is best shown in FIG. 3 and same is formed of cardboard or like material and comprises a single sheet or blank of such material generally indicated at 10 which is of generally rectangular shape. The blank or sheet 10 is scored transversely along spaced parallel score or fold lines 12 and 14 to provide a top section indicated at 16. Spaced transversely extending score or fold lines 18 and 20 are provided between the first mentioned score lines and said last mentioned score lines and spaced side sections designated at 22 and 24 respectively.

A bottom end locking section designated at 26 extends adjacent the side section 22 and forms one end of the sheet and said bottom locking section 26 is provided with a pair of spaced projecting tongues 28, the side edges 29 of which are curvilinear and terminate in a central pointed tip 30. The edge 32 between the tongues 28 is curvilinear. The bottom end section 26 has a central hinged locking flap 34 which is cut from the bottom section along the sides 36 and front end 37 but which is scored at 38 and connected to the bottom section so that the said flap 34 can be folded on score line 38 for interengagement with a slot on the opposite bottom section 43 adjacent side 24, to be described. The central locking flap 34 is further scored with a pair of score or fold lines 40 to form a triangle so that the flap 34 may be folded to be inserted into the slot, to be described, when interlocked therewith.

A transversely extending score or fold line 42 is spaced from the score line 20 to form a second bottom section 43 which is provided with slots and openings which are adapted to be interlocked with the locking means 28 and 34 on the end bottom section 26. Same comprises a pair of spaced elongated slots 44 and an intermediate spaced trapezoidal cutout 46. When the blank is folded along the score or fold lines the flaps 28 on the end bottom section 26 are inserted into the spaced slots 44 and the central flap 34 on the end bottom section 26 is inserted into the trapezoidal cutout 46.

Figure 2:
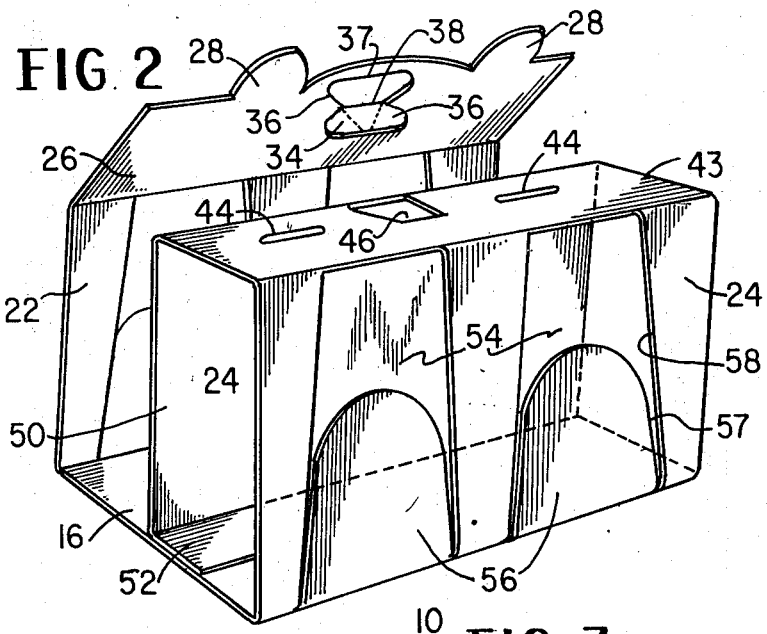
FIG. 2 is a view of the holder looking at same from the bottom and with the locking flap prior to its being locked.

A transverse score or fold line 48 spaced from the straight end edge 49 provides a partition section 50 and a narrow end section 52 which when the blank is folded, as shown in FIG. 2, the partition section 50 is positioned intermediate the opposite side sections 22 and 24 and parallel thereto, with the end section 52 folded to rest adjacent the inside of the top section 16 and parallel therewith.

Figure 1:
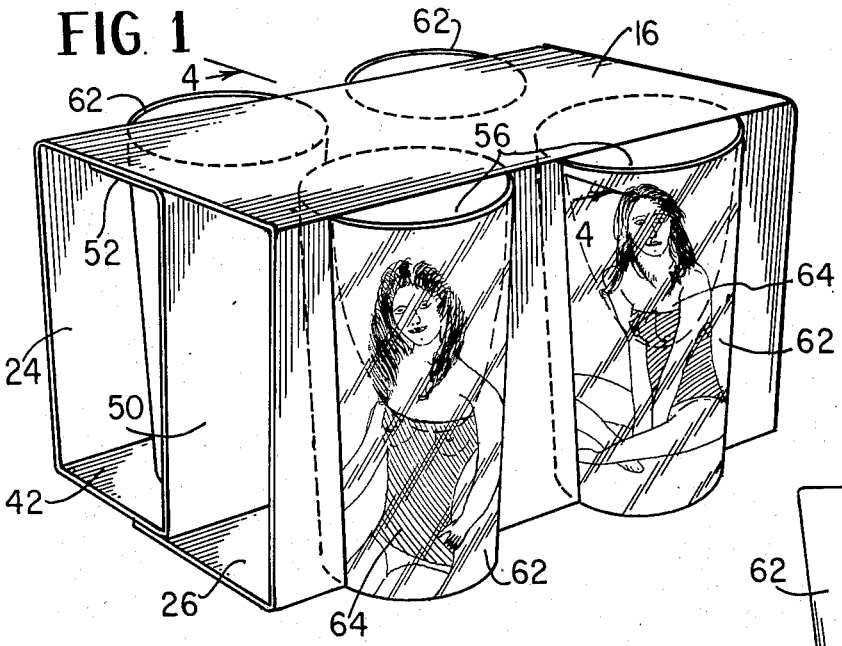
FIG. 1 is a perspective view of the complete package with the tumblers positioned in the holder in display position and locked therein.

The side sections 22 and 24 are each provided with a pair of spaced cutouts all generally designated by the numeral 54, with a flap 56 extending from the score or fold lines 12 and 14 respectively, into the cutout. These flaps are to be inserted inside the tumblers, as best seen in FIG. 1, and as will be more subsequently described. The flaps have their side edges 57 spaced from the adjacent edges 58 of the cutouts with the lower end of said flaps being rounded as at 60. The side edges 58 of the cutouts 54 are inclined or slope inwardly from the top section 16 toward their respective bottom sections 26 and 42 to provide a cutout shaped complementary to the shape of the tumbler. The blank is folded along the score lines and the partition section 50 is folded so that it is parallel to the side sections 22 and 24, with the end section 52 positioned adjacent the top section 16 and parallel thereto.

Figure 4:
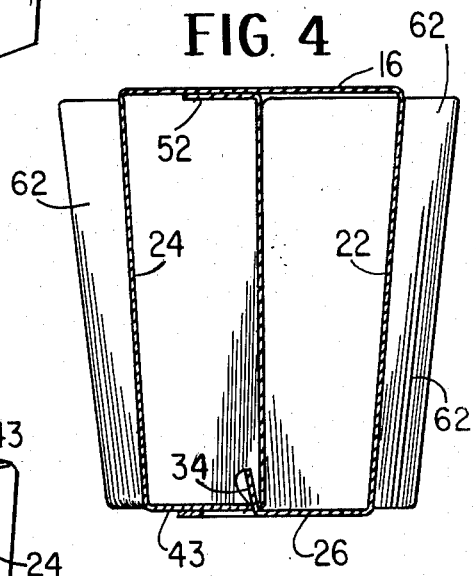
FIG. 4 is a sectional view taken on line 4—4 of FIG. 1.

A pair of tumblers or drinking glasses, all generally designated by the numeral 62 is inserted on the opposite sides of the partition section 50, with the flaps 56 inserted inside the tumbler and with the bottom of the tumbler resting on bottom sections 26 and 43. The tumblers extend partially inside the holder and partially outside the holder. After the bottom sections 26 and 43 are interlocked, as heretofore described, the four tumblers will be locked in the holder. It will be seen that the major portion of the tumbler on each side is positioned between the partition section 50 and its respective side section and a smaller portion of the circumference of the tumbler extends outwardly of the cutout 54 so that the tumblers while held securely in the holder have their front faces extending outwardly of the holder, as best shown in FIGS. 1 and 4.

The purpose of displaying the tumblers in this manner is so that the particular picture 64 which is on the face of each tumbler is visible to the viewer and is unobstructed or uncovered, thus, insofar as the packaging of four tumblers is concerned, the four pictures would be visible to the customer while the tumblers are held securely locked in a packaged condition.

What is claimed is:

1. A package unit comprising a plurality of drinking glasses and a holder for holding a plurality of drinking glasses on each side of said holder in a display condition, each said drinking glass having an ornamental design or picture extending across the front thereof, said holder comprising a single blank of sheet material, said blank sheet having a top section and opposite first and second side sections, with one of each of said side sections adjacent said top section, a bottom end locking section adjacent said first side section, a second bottom section adjacent said second side section, a partition section adjacent said second bottom section and an end section adjacent said partition section, said first and second side sections each having a plurality of elongated cutouts and a flap extending from said top section inwardly into each said cutout, said bottom end locking section having a locking tongue and said second bottom section having a slot engaged by said locking tongue for interlocking therewith, said blank being folded so that the partition section is centrally and longitudinally and vertically positioned intermediate the vertically positioned first and second side sections and extending parallel thereto, and extending the height and length of said package unit, with said end section being horizontally positioned and parallel to and contiguous to the underside of said horizontally positioned top section to support said top section, and said plurality of drinking glasses on each side are each positioned inside one of said elongated cutouts and the first and second side sections with a plurality of glasses resting on said bottom end locking section and a plurality of glasses resting on said second bottom section, with the flaps extending into the drinking glasses and with a portion of each of the drinking glasses contiguous to the partition section and the front portion of each said drinking glass which has said ornamental design or picture extends outwardly and forwardly of its respective side section so that the ornamental design or picture on said front surface of the drinking glass is visible and unobstructed, said drinking glasses on each side each being spaced from each other and separated by said partition from the drinking glasses on the other side with none of said glasses contacting each other, said partition also blocking the simultaneous viewing of the ornamental design or picture of the plurality of glasses on the side opposite from the side being viewed, said interlocking means being interlocked for retaining said drinking glasses in the package unit in a display condition without the use of adhesive or extraneous fastening means, the opposite ends of the package unit being open with the drinking glasses positioned inwardly of the opposite ends.

* * * * *